US005548887A

United States Patent [19]

Klappert

[11] Patent Number: 5,548,887

[45] Date of Patent: Aug. 27, 1996

[54] METHOD OF MAKING A TRANSFORMER CORE FROM STRIPS OF AMORPHOUS STEEL

[75] Inventor: Willi Klappert, Hickory, N.C.

[73] Assignee: General Electric Company, Plainville, Conn.

[21] Appl. No.: 344,093

[22] Filed: Nov. 22, 1994

[51] Int. Cl.[6] ..... H01F 41/02

[52] U.S. Cl. ..... 29/609; 29/738

[58] Field of Search ..... 29/605, 606, 609, 29/738

[56] References Cited

U.S. PATENT DOCUMENTS

| | | | |
|---|---|---|---|
| 4,972,573 | 11/1990 | Yamamoto et al. | 29/609 |
| 5,230,139 | 7/1993 | Klappert et al. | 29/564.6 |
| 5,315,754 | 5/1994 | Klappert et al. | 29/609 |
| 5,329,270 | 7/1994 | Freeman | 336/213 |

*Primary Examiner*—Carl E. Hall

*Attorney, Agent, or Firm*—Carl B. Horton; William Freedman

[57] ABSTRACT

This method employs a rotatable mandrel having a circular outer peripheral portion comprising a section that is removably held in place within the peripheral portion and has an arcuate outer surface forming a part of said circular outer peripheral portion. As the mandrel is rotated, there is formed about the circular outer peripheral portion a toroidal core form that comprises laminations of amorphous steel strip having ends that meet in a joint region that extends angularly about a restricted zone of the toroidal core form. This forming step is so controlled that said restricted zone angularly aligns with the removable section of the mandrel. After the core-forming step, the removable section is removed from the mandrel thereby exposing an inner peripheral portion of the toroidal core form that angularly aligns with said restricted zone. Then, into the space vacated by removal of the removable section, there is inserted a forming member having a generally flat surface that aligns with and faces said exposed inner peripheral portion of the toroidal core form. Then, the portion of the core form in said joint region is clamped to said flat surface of the forming member with a clamping mechanism applied in said joint region, following which the core form together with the applied clamping mechanism is removed from the mandrel. Thereafter, the core form is shaped into a rectangular configuration.

6 Claims, 5 Drawing Sheets

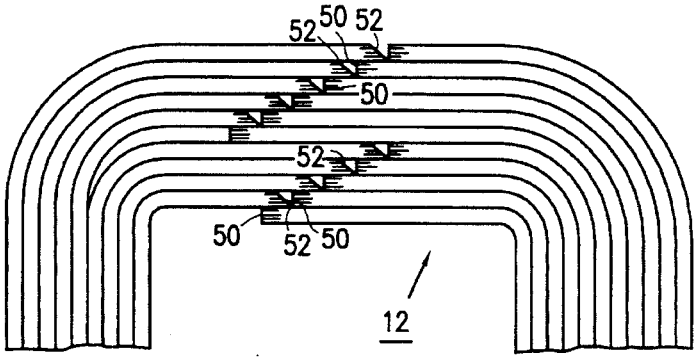
*Fig. 1*
PRIOR ART
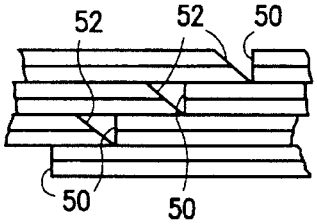
*Fig. 2*
PRIOR ART
*Fig. 3*
PRIOR ART
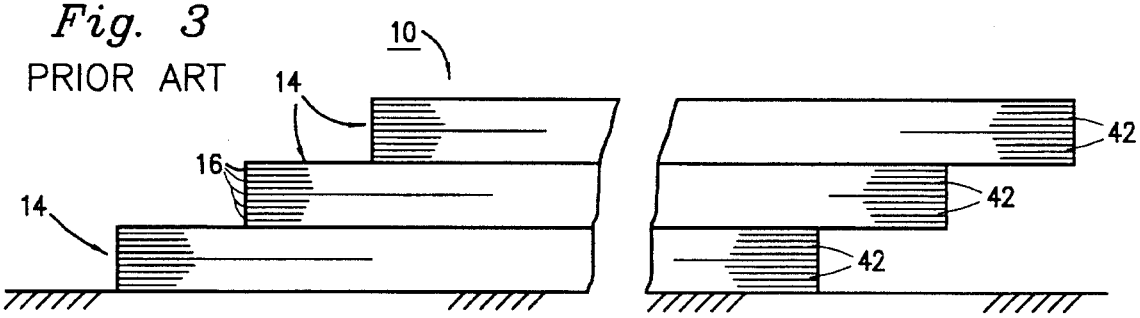
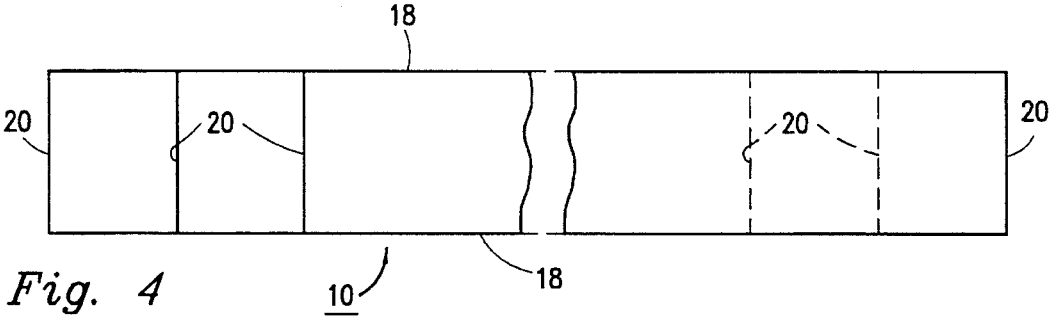
*Fig. 4*
PRIOR ART

METHOD OF MAKING A TRANSFORMER CORE FROM STRIPS OF AMORPHOUS STEEL

CROSS-REFERENCE TO RELATED PATENTS

This invention is related to the inventions described and claimed in the following patents, each of which is incorporated by reference in the present application:

U.S. Pat. No. 5,315,754—Klapper and Houser

U.S. Pat. No. 5,230,139—Klapper and Houser

U.S. Pat. No. 5,329,270—Freeman

TECHNICAL FIELD

This invention relates to a method for making a transformer core from strips of amorphous steel and, more particularly, relates to a method of this type which employs a rotatable mandrel on which a toroidal core form is built up from pre-cut strips of amorphous steel wrapped around the mandrel as it rotates.

BACKGROUND

In a typical method of the above type, the toroidal core form of amorphous steel strip, after being built up about the rotating mandrel, is removed from the mandrel and is then formed into a rectangular configuration. When the toroidal core form of amorphous steel strip is removed from the mandrel, it has little ability to resist collapsing in a radially inward direction, especially if it is a large diameter core. Various techniques have been used for preventing such collapse, but these have not been as successful as might be desired. Collapse of the core form can be a serious problem since once the core form has collapsed, it is very time-consuming, and sometimes not even feasible, to restore it to its original configuration. Typically, collapse of the core form will pull apart some or all of the joints in the core form, and if these joints are not restored to their proper sequence, a core failure can occur when the core is subsequently placed in operation.

U.S. Pat. No. 4,972,573—Yamamota et al discloses a core-making method that employs a static mandrel about which strips of amorphous steel are wrapped. This mandrel has an outer periphery that is circular except for a portion of the outer periphery that is formed by a removable section with a flat outer surface. Such a flat outer surface cannot be tolerated in a method such as mine that uses a dynamic mandrel, i.e., a mandrel that rotates as the core form is built up thereon. If the core form built up on a dynamic mandrel has a flattened outer region, this flattened region would cause the rotating mandrel and core form to be out of balance dynamically, thus causing undesirable bouncing around of the mandrel as it is rotated during build-up of the core form. Another disadvantage of employing a mandrel having a flattened outer region in a method that uses a dynamic mandrel and a belt wrapped about the mandrel, i.e., a belt nester, such as I use, is that the flattened outer region interferes with imparting from the belt to the amorphous strips the proper tension as the strips are wrapped about the mandrel.

OBJECTS

An object of my invention is to provide , in a method of making a transformer core in which strips of amorphous steel are wrapped about a dynamic mandrel, an improved technique for preventing collapse of the core form when it is removed from the mandrel.

Another object is to provide, in a method of the above type, an improved technique for holding the joints of the core form in properly assembled relationship when the core form has been removed from the mandrel.

SUMMARY

In carrying out the invention in one form, I provide the following method for making a transformer core from strips of amorphous steel. First I provide a rotatable mandrel having a circular outer peripheral portion comprising a section that is removably held in place within the peripheral portion and has an arcuate outer surface forming a part of said circular outer peripheral portion. As the mandrel is rotated, I form about the circular outer peripheral portion a toroidal core form that comprises laminations of amorphous steel strip having ends that meet in a joint region that extends angularly about a restricted zone of the toroidal core form. This forming step is controlled in such a manner that said restricted zone angularly aligns with the removable section of the mandrel. After the core-forming step, I remove the removable section, thereby exposing an inner peripheral portion of the toroidal core form that angularly aligns with said restricted zone. Then I insert into the space vacated by removal of the removable section a forming member having a generally flat surface that aligns with and faces said exposed inner peripheral portion of the toroidal core form. I then clamp the portion of the core form in said joint region to said flat surface of the forming member with a clamping mechanism applied in said joint region, following which I remove from the mandrel the core form together with the applied clamping mechanism. When the core form is thus removed, the clamping mechanism prevents the core form from collapsing and also maintains the joints in their proper assembled relationship. Thereafter, the core form is shaped into a rectangular configuration by applying radially-outward directed force to said forming member and to a portion of the core form diametrically opposed to the joint region.

BRIEF DESCRIPTION OF FIGURES

For a better understanding of the invention, reference may be had to the following detailed description taken in connection with the accompanying drawings, wherein:

FIG. 1 is a sectional view of a portion of a rectangular transformer core, this portion containing a restricted zone in which the core joints are located. Cores of this form are part of the prior art.

FIG. 2 is an enlarged view of some of the joints of the FIG. 1 core.

FIG. 3 is an enlarged side elevational view of a packet of amorphous steel strip used in manufacturing the core of FIG. 1.

FIG. 4 is a plan view of the packet of FIG. 3.

Figure 7A:
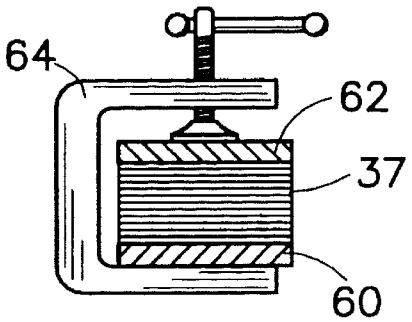
FIG. 7 shows the core form with clamping means applied to its joint region and the core form still on the mandrel.
Figure 7:
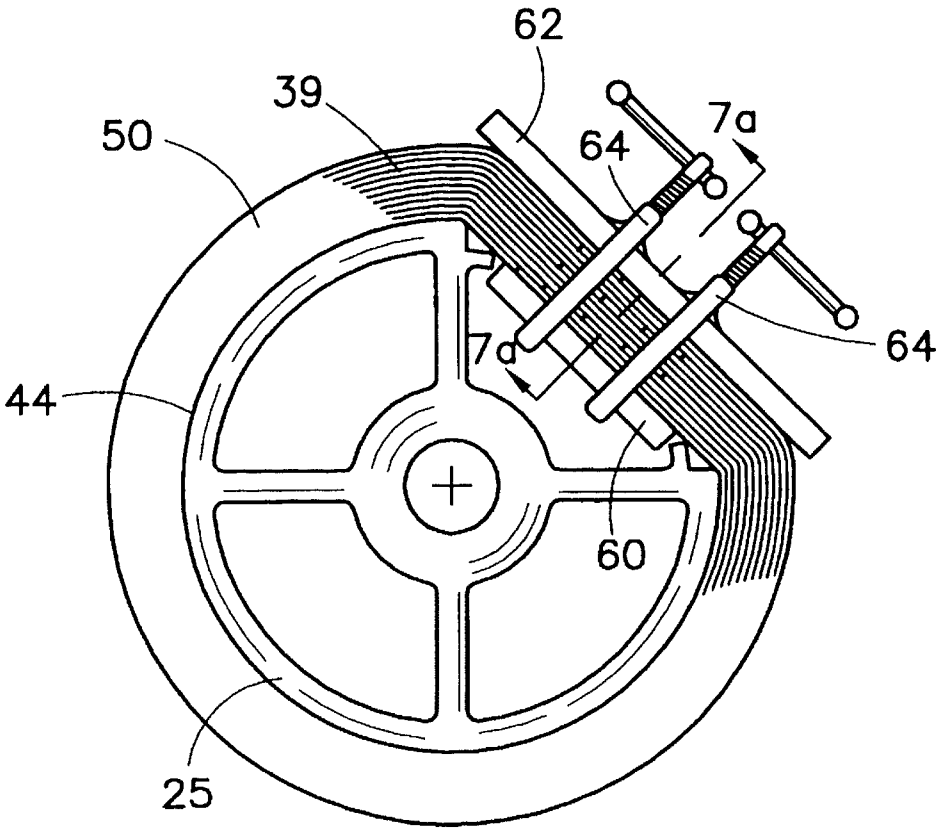

FIG. *7a* is a sectional view taken along the line *7a—7a* of FIG. 7.

Figure 8:
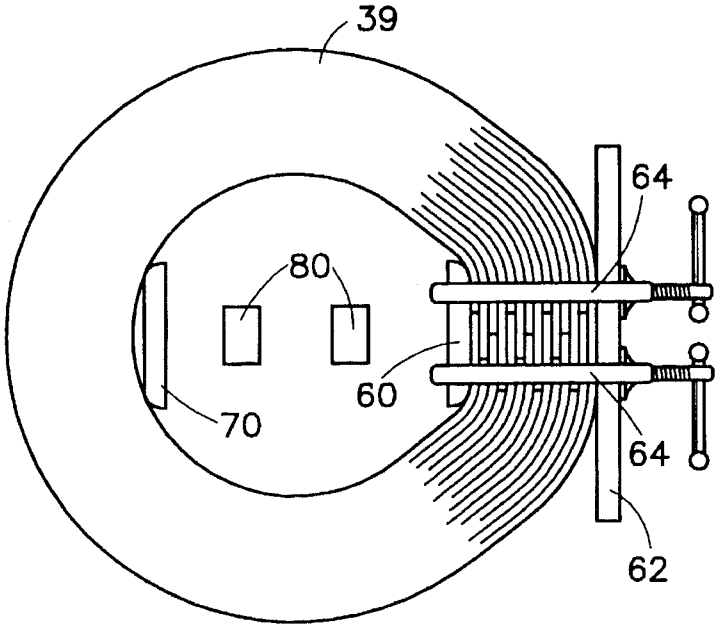

FIG. 8 shown the core form removed from the mandrel and with a forming arbor present in its window.

Figure 9:
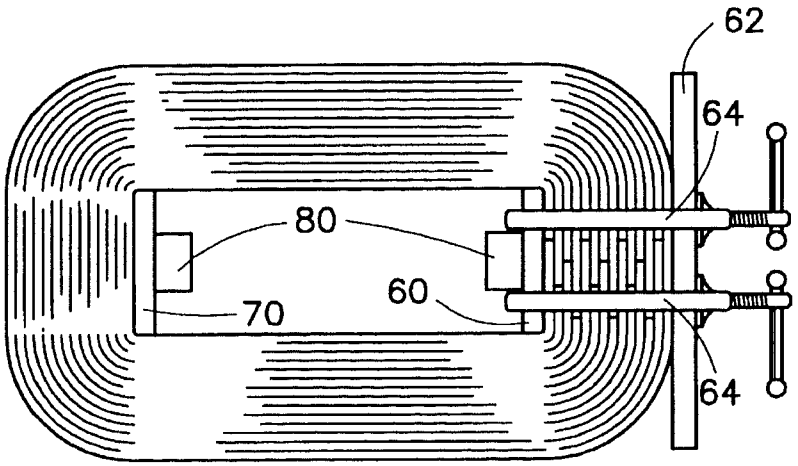

FIG. 9 shows the core form after being shaped into a rectangular configuration by the forming arbor.

DETAILED DESCRIPTION OF EMBODIMENT

The type of transformer core that I am concerned with is made by wrapping about the rotating mandrel of a core-making machine laminations of amorphous steel strip. Preferably, stacks of these laminations are pre-cut to the proper length and assembled in packets before the wrapping operation. A typical prior art form of one of these packets is shown at 10 in FIGS. 3 and 4, and a core that is made with such packets is illustrated at 12 in FIG. 1.

The packet shown in FIGS. 3 and 4 comprises three groups 14 of amorphous steel strip material, each group comprising many thin laminations 16 of amorphous steel strip stacked in superposed relationship. Each lamination has longitudinally-extending edges 18 at its opposite sides and transversely-extending edges 20 at its opposite ends. In the prior art construction shown in FIGS. 3 and 4, the laminations 16 in each group have their longitudinally-extending edges 18 at each side disposed in alignment and their transversely-extending edges 20 at each end of the group disposed in alignment.

Figure 5:
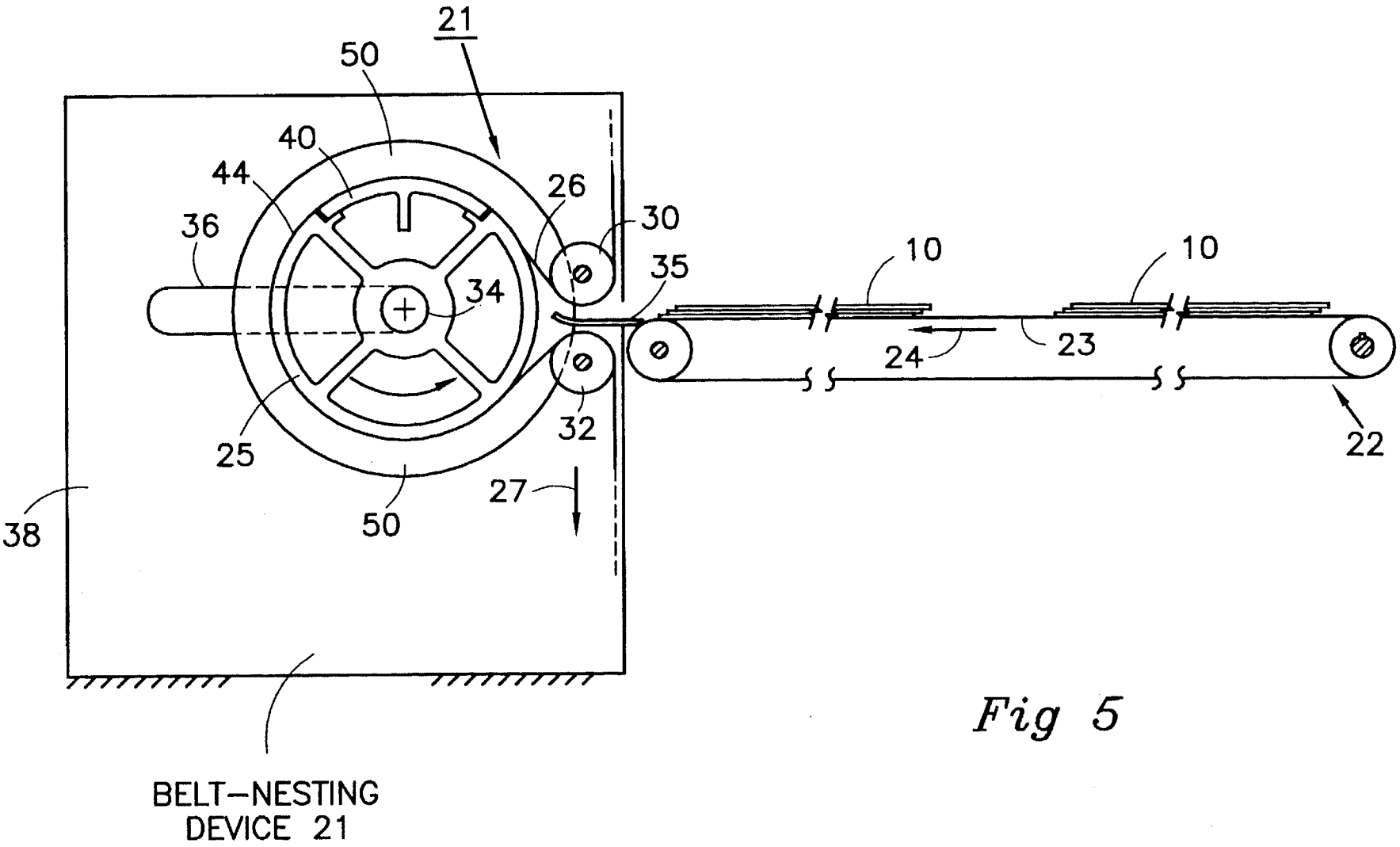
FIG. 5 illustrates in simplified form a core-making machine used in practicing my invention and for making the core of FIG. 1. The machine illustrated in FIG. 5 includes a rotatable mandrel about which the core form is built up.

In practicing my method in one form, I utilize the core-making machine of FIG. 5. This machine includes many of the features disclosed and claimed in the above referenced U.S. Pat. Nos. 5,315,754 and 5,230,139—Klappert and Houser and is therefore shown in simplified form in FIG. 5. The machine of FIG. 5 comprises a belt-nesting device 21 into which the above-described packets 10 are fed by a conveyer system 22 comprising a belt drive 23 that transports the packets in the direction of arrow 24. The belt-nesting device 21 comprises a rotatable mandrel 25 having a horizontal axis encircled by a flexible belt 26. Individual packets 10 of strips are guided into the space between the belt and mandrel, where they are wrapped about the mandrel as the belt 26 moves in the direction of arrow 27 to rotate the mandrel in a counter-clockwise direction. Where the packets of strips enter the space between the belt and the mandrel, there are two vertically-spaced front rollers 30 and 32 about which the belt 26 is partially wrapped. A thin guide 35 directs the packets generally upward as they enter the gap between the rollers. The rollers 30 and 32 serve as guide rollers for the belt 26 and are rotatable mounted on fixed axes. As shown in the aforesaid Klappert and Houser patents, the belt 26 is an endless flexible belt that extends externally of the mandrel 25 and guide rollers 30 and 32 around a series of additional guide rollers, tensioning rollers, and a motor-driven pulley (none of which are shown in the present application) to enable the belt to be appropriately driven as shown. The mandrel 25 is supported on a shaft 34 which is slidably mounted in slots 36 in stationary support members 38. As the core form is built up about the mandrel, the shaft 34 is forced to shift to the left in the slots 36 against the opposing bias of the belt-tensioning device (not shown), thus providing room for new packets of strips fed onto the mandrel. The Klappert and Houser patents illustrate in more detail how the individual packets are fed into the belt-nesting device and wrapped one at a time about the mandrel.

After a toroidal core form 39 of the desired build has been formed in the belt-nesting device 21, this core form is removed from the mandrel 25 of the belt-nesting device and is shaped into the generally rectangular form of FIG. 9, all in a manner soon to be described. Thereafter, the shaped core form is placed in an annealing oven, where it is heated and then slowly cooled to relieve stresses in the amorphous steel strip material. The annealing step is conventional and is not illustrated in the drawings.

Figure 6:
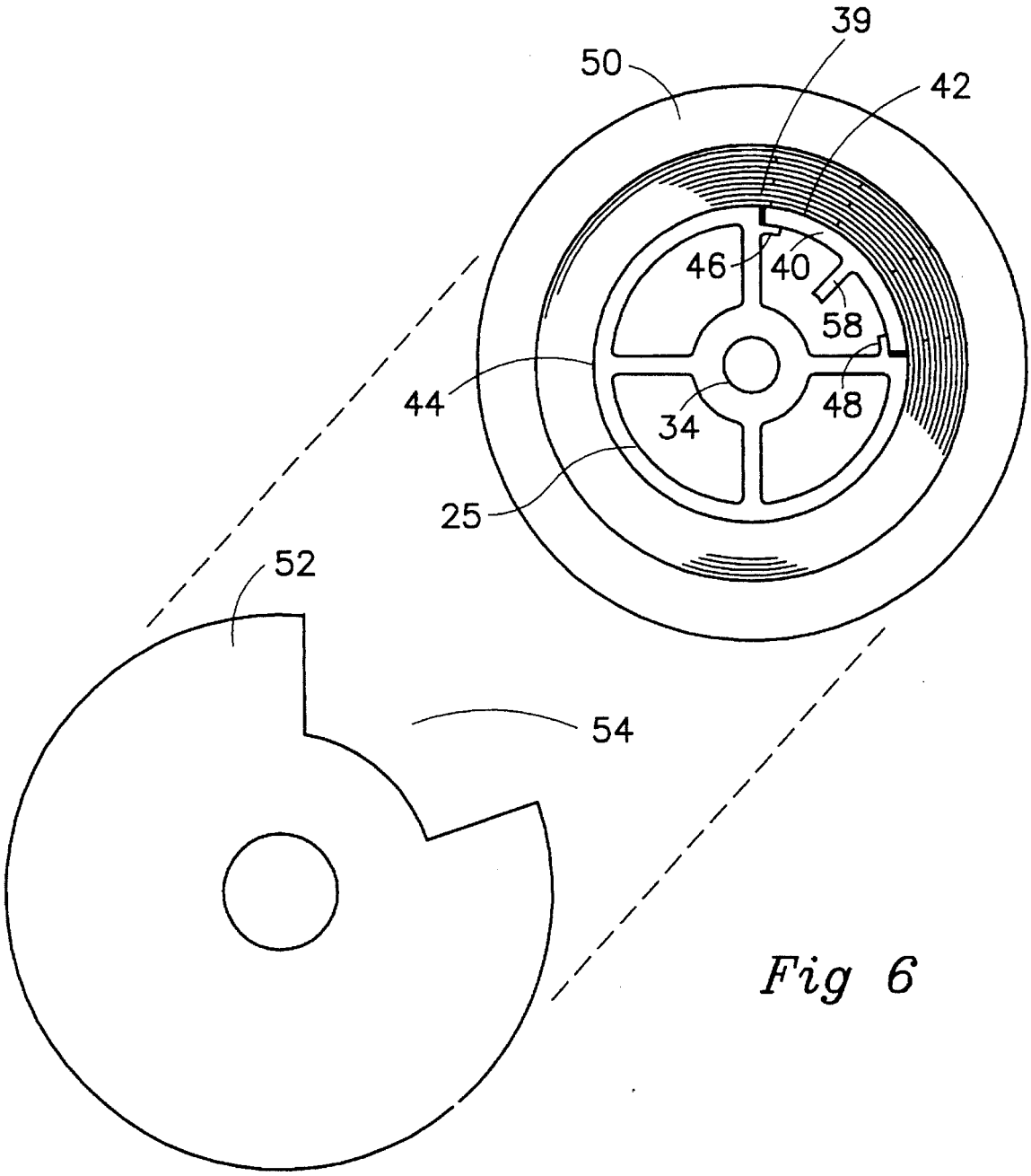
FIG. 6 is a side elevational view of the mandrel present in the machine of FIG. 5 after the core form has been built up thereon. The mandrel includes side plates, one of which is shown removed from the body of the mandrel and in an exploded position.

To facilitate removal of the toroidal core form 39 from the mandrel 25, the mandrel is provided with a removable section 40, as shown in FIG. 6. This section has an arcuate outer portion 42 that forms a part of the circular outer peripheral portion 44 of the mandrel. The radius of curvature of the outer portion 42 of the section 40 is substantially the same as the radius of curvature of the remainder of the outer peripheral portion 44. Also the center of curvature of outer portion 42 substantially coincides with the center of curvature of the remainder of the outer peripheral portion 44.

Section 40 is supported in its position of FIG. 6 by a pair of lugs 46 and 48 that are joined to adjacent portions of the rim of the mandrel and extend circumferentially for a short distance beneath the section 40. After the core form 39 has been wound onto the mandrel, as above described, the section 40 can be removed from its position of FIG. 6 by sliding it axially of the mandrel out from under the core form. This will expose a portion of the inner periphery of the core form 39 for clamping, as will soon be explained.

The mandrel 25 is provided with a pair of circular side plates 50 and 52 removably secured to the body of the mandrel at its axially-opposed faces, as schematically shown in FIG. 6. These side plates project radially outward beyond the outer peripheral portion 44 of the mandrel to form a space of U-shaped cross-section encircling the outer periphery. In this U-shaped space the core form is built up as the packets are wound about the mandrel. One of these side plates 52 includes a window 54 that is disposed in alignment with the removable section 40. Through this window 54 the operator of the core-making machine can view the joints that are being formed between the ends of the laminations in the core form.

The core-making machine is operated in such a manner that the joints between the laminations are all located in an angularly restricted zone of the core form that is aligned with the removable section 40. The operator can see through the window 54 whether such alignment is being achieved as the core-winding operation proceeds and can take suitable corrective action if the desired alignment is not occurring.

After the core-winding operation has been completed, the side plates 50 and 52 are removed from the mandrel body, and the mandrel body, with the toroidal core form 39 present on its outer periphery, is removed from the core-making machine and is placed with one face on a flat horizontal surface with its axis extending vertically. Then, the removable section 40 is slid axially of the mandrel out from under the core form 39 encircling the outer periphery of the mandrel. To facilitate removal of section 40, it is provided with a radially-inwardly-extending handle 58 that can be gripped by the operator as he applies force to slide the section 40 in an upward direction.

After the section 40 has thus been removed, the operator places a forming block 60 against the inner periphery of the core form in the location vacated by the section 40, as is shown in FIG. 7. An outer plate 62 is then positioned on the outer periphery of the core form in a location opposite the forming block 60. The block 60 and the plate 62 are then forced together by two C-clamps 64 with the restricted joint zone of the core form clamped between the block and plate. The two C-clamps 64 may be thought of as a clamping mechanism.

As a next step, the mandrel 25 is pulled in an axial direction out of the surrounding core form 39. This can be done manually or, if necessary, by using an overhead hoist. During and after removal of the mandrel, the joint zone of the core form is held firmly together by the C-clamps 64 and the block 60 and plate 62, and this prevents any collapse of the core form radially inwardly and holds all the joints in their correctly assembled relationship.

Referring to FIG. 8, once the mandrel 25 has been removed, another forming block 70 is placed within the core window in a position diametrically opposite the first forming block 60. Thereafter the two forming blocks 60 and 70 are forced apart in a radial direction by a conventional forming arbor 80, thereby imparting the desired rectangular configuration to the core form, as shown in FIG. 9.

It is to be noted that the two forming blocks 60 and 70 have substantially flat surfaces for engaging the inner periphery of the core form 25 during the core-shaping step. This substantially flat configuration is needed in order to achieve the desired rectangular cross-section of the finished core.

Although I have shown my method as applied to a core have joints of the type shown in FIGS. 1 and 2, it is to be understood that my method is also applicable to cores having other types of joints, e.g., joints of the type illustrated in FIGS. 6 and 7 of the aforesaid U.S. Pat. No. 5,329,270—Freeman and conventional butt-joints.

While I have shown and described a particular embodiment of the invention, it will be obvious to those skilled in the art that various changes and modifications may be made without departing from the invention in its broader aspects; and I therefore intend herein to cover all such changes and modifications as fall within the true spirit and scope of the invention.

What I claim as new and desire to secure by Letters Patent of the United States is:

1. A method of making a transformer core from strips of amorphous steel, comprising the following steps:

(a) providing a rotatable mandrel having a circular outer peripheral portion comprising a section that is removably held in place within said peripheral portion, said section having an arcuate outer surface that forms a part of said circular outer peripheral portion, (b) forming about said circular outer peripheral portion a toroidal core form that comprises laminations of amorphous steel strip encircling said mandrel and having ends that meet in a joint region that extends angularly about a restricted zone of said toroidal core form, said forming step being effected by rotating said mandrel while feeding said laminations onto said circular outer peripheral portion of the mandrel, (c) controlling the forming step in such a manner that said restricted zone angularly aligns with said removable section, (d) removing said removable section, thereby exposing an inner peripheral portion of said toroidal core form that angularly aligns with said restricted zone, (e) inserting a forming member into the space vacated by removal of said removable section, (f) clamping the portion of said core form in said joint region to said forming member with a clamping mechanism applied in said joint region, (g) removing from said mandrel the core form together with said applied clamping mechanism, and (h) shaping said core form into a rectangular configuration by applying radially-outward directed force to said forming member and to a portion of said core form diametrically opposed to said joint region.

2. The method of claim 1 in which rotation of said mandrel during said forming step is effected by a belt wrapped partially around said mandrel and driven along the length of said belt and by feeding said amorphous steel strips into a space between said belt and the outer peripheral portion of said mandrel.

3. The method of claim 1 in which said clamping of the joint-region portion of said core form to said forming member is effected by applying to the outer periphery of said core form a member of plate form and by utilizing said clamping mechanism to force said member of plate form toward said forming member to clamp the joint-region portion of the core form between said member of plate form and said forming member.

4. The method of claim 1 in which said forming member has a substantially flat surface for bearing against said inner peripheral portion of said toroidal core form when the joint region portion of the core form is clamped to said forming member.

5. The method of claim 1 in which said shaping step is performed while the clamping mechanism remains applied to said portion of said core form in said joint region.

6. The method of claim 3 in which said shaping step is performed while the clamping mechanism remains applied to said joint-region portion of said core form.

* * * * *